US006224159B1

(12) United States Patent
Perry

(10) Patent No.: US 6,224,159 B1
(45) Date of Patent: May 1, 2001

(54) FLEXIBLE CHAIR WHICH CAN BE DISASSEMBLED TO A FLAT CONFIGURATION

(76) Inventor: Charles Owen Perry, 20 Shorehaven Rd., Norwalk, CT (US) 06855

( * ) Notice: Subject to any disclaimer, the term of this patent is extended or adjusted under 35 U.S.C. 154(b) by 0 days.

(21) Appl. No.: 09/310,448

(22) Filed: May 12, 1999

(51) Int. Cl.[7] ..... A47C 7/00

(52) U.S. Cl. ..... 297/440.1; 297/411.42; 297/440.23; 297/448.2

(58) Field of Search ..... 297/286, 287, 297/296, 297, 301.1, 301.5, 323, 340, 354.1, 411.28, 411.42, 440.1, 440.11, 440.14, 440.23, 448.1, 448.2, 452.2

(56) References Cited

U.S. PATENT DOCUMENTS

| | | | |
|---|---|---|---|
| D. 102,099 | 11/1936 | Wexelblatt | 297/288 X |
| 142,145 | 8/1873 | Chichester . | |
| 346,454 | 8/1886 | Baldwin . | |
| 790,242 | 5/1905 | Yeager . | |

(List continued on next page.)

FOREIGN PATENT DOCUMENTS

| | | | |
|---|---|---|---|
| 464380 | 4/1946 | (BE) . | |
| 549892 * | 12/1959 | (BE) | 297/440.23 |
| 632397 | 12/1961 | (CA) . | |
| 1 249 503 | 1/1989 | (CA) | A47C/3/04 |
| 88021 | 10/1895 | (DE) . | |
| 31 00 770 | 8/1982 | (DE) . | |
| 3635811 A1 | 10/1986 | (DE) | A47C/1/00 |
| 0 173 372 A2 | 7/1985 | (EP) | A47C/1/032 |
| 0 295 214 A1 | 12/1988 | (EP) | A47C/7/44 |
| 60468 | 11/1954 | (FR) | 9/4 |
| 1196751 | 5/1959 | (FR) . | |
| 610741 | 10/1948 | (GB) | 297/296 |
| 666933 * | 2/1952 | (GB) | 297/448.1 |
| 754209 | 8/1956 | (GB) . | |
| 73031 | 11/1986 | (IL) | A47C/1/024 |
| 208410 | 6/1984 | (NZ) . | |
| 220 502 | 5/1987 | (NZ) . | |

OTHER PUBLICATIONS

Krueger International Inc., Advertising Brochure for "Matrix Chair ", 1989.

*Primary Examiner*—Laurie K. Cranmer
(74) *Attorney, Agent, or Firm*—Gray, Cary, Ware & Freidenrich LLP

(57) ABSTRACT

A flexible chair which can be easily disassembled to or assembled from a flat or substantially flat configuration for storage or shipment. The chair includes a pivoting seat and back assembly and a frame supporting the seat and back assembly. The seat and back assembly includes a flat seat portion, a back portion, a set of one or more hinges connecting together the seat and back portions, and fabric or other material for supporting the user. The back portion has freedom to pivot relative to the seat portion and frame between a reclining position and an upright position, with the back portion being prevented from pivoting in a first rotational direction relative to the frame beyond the reclining position and the back portion being prevented from pivoting in the opposite rotational direction relative to the frame beyond the upright position. The frame is configured to bias the back portion in the upright position but is sufficiently flexible to allow the user to move the back portion from the upright position into the reclining position. Preferably, when the back portion is tilted backward into the reclining position, the chair reacts by causing the seat portion to tilt upward and forward to support to the reclining user. Preferably, each of the seat portion and back portion is substantially flat, and the frame includes a number of flat tubular pieces that are connectable together by key hole fasteners, screws or bolts, or other connectors.

27 Claims, 7 Drawing Sheets

U.S. PATENT DOCUMENTS

| | | | | |
|---|---|---|---|---|
| 1,191,438 | | 7/1916 | Kilburn . | |
| 1,791,453 | | 2/1931 | Mies . | |
| 1,964,519 | | 6/1934 | Knudsen | 155/116 |
| 2,089,818 | * | 8/1937 | Terker | 297/440.23 X |
| 2,115,258 | * | 4/1938 | Ferreira et al. | 297/448.1 X |
| 2,266,897 | | 12/1941 | Nordmark | 155/84 |
| 2,345,926 | | 4/1944 | Fields et al. | 155/157 |
| 2,419,838 | | 4/1947 | James | 155/2 |
| 2,512,353 | | 6/1950 | Magaldino et al. | 155/116 |
| 2,532,025 | | 11/1950 | Johnson | 155/54 |
| 2,586,951 | | 2/1952 | Johnson | 155/54 |
| 2,617,471 | | 11/1952 | Lorenz | 155/106 |
| 2,637,371 | | 5/1953 | Boutin | 155/50 |
| 2,803,291 | | 8/1957 | Meyer | 155/153 |
| 2,838,095 | | 6/1958 | Deaton | 155/157 |
| 2,857,958 | | 10/1958 | Wright | 155/156 |
| 2,874,755 | | 2/1959 | Smith | 155/2 |
| 2,952,300 | | 9/1960 | Cohen | 297/239 |
| 2,961,035 | | 11/1960 | Lorenz | 155/106 |
| 3,095,238 | | 6/1963 | Tarascon | 297/306 |
| 3,115,368 | | 12/1963 | Springer et al. | 297/451 |
| 3,246,927 | | 4/1966 | Klassen | 297/239 |
| 3,266,843 | | 8/1966 | Feder | 297/440 |
| 3,316,016 | | 4/1967 | Petersen | 297/239 |
| 3,334,942 | | 8/1967 | Breslow | 297/1 |
| 3,446,532 | | 5/1969 | Cramer | 297/312 |
| 3,482,874 | | 12/1969 | Henebry et al. | 297/445 |
| 3,712,666 | | 1/1973 | Stoll | 297/61 |
| 3,741,607 | | 6/1973 | Cramer | 297/302 |
| 3,815,955 | | 6/1974 | Gibilterra | 297/295 |
| 3,817,573 | | 6/1974 | Facury | 297/125 |
| 3,822,079 | | 7/1974 | Probber | 297/445 |
| 3,847,433 | | 11/1974 | Acton et al. | 297/239 |
| 3,999,802 | | 12/1976 | Powers | 297/447 |
| 4,131,315 | | 12/1978 | Vogtherr | 297/286 |
| 4,209,198 | * | 6/1980 | Apple, Sr. | 297/448.1 X |
| 4,522,444 | | 6/1985 | Pollock | 297/239 |
| 4,529,246 | | 7/1985 | Leib | 297/285 |
| 4,545,615 | | 10/1985 | Kane | 297/287 |
| 4,548,441 | | 10/1985 | Ogg | 297/239 |
| 4,570,994 | | 2/1986 | Lowrey | 297/19 |
| 4,640,548 | | 2/1987 | Desanta | 297/320 |
| 4,641,885 | | 2/1987 | Brauning | 297/300 |
| 4,648,653 | | 3/1987 | Rowland | 297/239 |
| 4,653,806 | | 3/1987 | Willi | 297/300 |
| 4,660,884 | * | 4/1987 | Terui et al. | 297/440.23 X |
| 4,711,491 | | 12/1987 | Ginat | 297/301 |
| 4,732,424 | | 3/1988 | Uredat-Neuhoff | 297/317 |
| 4,744,600 | | 5/1988 | Inoue | 297/326 |
| 4,787,319 | | 11/1988 | Dupraz | 108/64 |
| 4,819,986 | | 4/1989 | Markus | 297/325 |
| 4,840,426 | | 6/1989 | Vogtherr et al. | 297/300 |
| 4,880,273 | | 11/1989 | Markus | 297/325 |
| 5,009,466 | | 4/1991 | Perry | 297/323 |
| 5,131,715 | | 7/1992 | Balles | 297/5 |
| 5,180,208 | | 1/1993 | Lawandi | 297/440 |
| 5,308,142 | | 5/1994 | Forslund, III et al. | 297/286 |
| 5,338,094 | | 8/1994 | Perry | 297/411.4 |
| 5,383,712 | | 1/1995 | Perry | 297/448 |
| 5,626,394 | | 5/1997 | Perry | 297/448.2 |
| 6,056,361 | * | 5/2000 | Cvek | 297/448.2 X |

* cited by examiner

FIG. 12
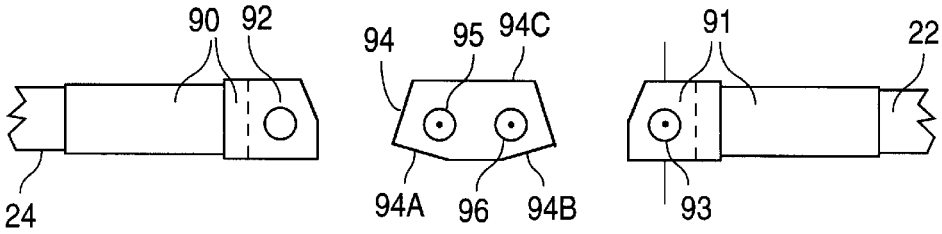
FIG. 13
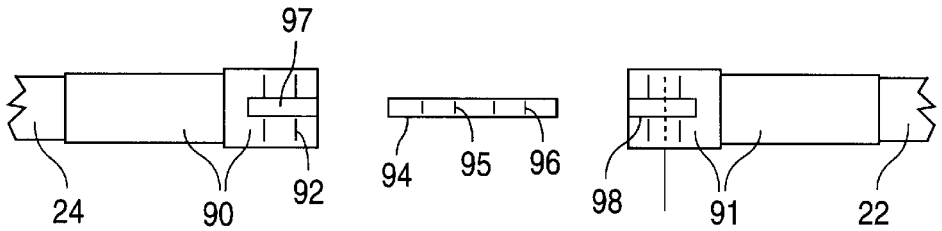
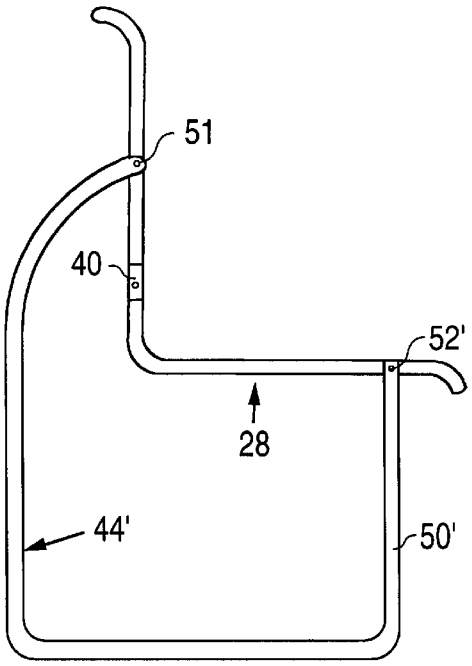
FIG. 14

FLEXIBLE CHAIR WHICH CAN BE DISASSEMBLED TO A FLAT CONFIGURATION

FIELD OF THE INVENTION

The invention pertains to a chair having a flexible frame, and which can be easily disassembled to and assembled from a flat configuration for storage or shipment. In preferred embodiments, the chair includes a pivoting seat and back assembly (including an upper back portion which pivots with respect to the rest of the assembly) and a flexible frame which supports the seat and back assembly with freedom for the upper back portion to recline relative to the frame. The frame includes flat or substantially flat pieces which can be connected (preferably detachably connected) by key and keyhole fasteners, screws, or other suitable connectors.

BACKGROUND OF THE INVENTION

U.S. Pat. No. 5,383,712, issued to Charles O. Perry discloses several embodiments of a chair having a seat, a back, and a frame which flexes to permit partial reclining of the back. The flexible frame is biased into a configuration in which the back is upright. When the user tilts the back into a reclining position (thereby flexing the frame as well as pivoting the back relative to the frame), the frame (as it flexes) lifts up the rear portion of the seat, thus orienting the seat so as to provide better support for the reclining user. The frame implements stops which limit the amount by which the back can pivot relative to the frame.

However, the chair described in U.S. Pat. No. 5,383,712 is not designed to be knocked down into a flat (or substantially flat) state. Until the present invention, it had not been known how to implement a chair which can be pivoted into a reclining configuration and which is also designed to be readily disassembled into (and then reassembled from) a flat or substantially flat state.

SUMMARY OF THE INVENTION

In preferred embodiments, the invention is a chair including a pivoting seat and back assembly (which can be disassembled to or assembled from a flat or substantially flat configuration) and a frame (which can be disassembled to or assembled from flat or substantially flat pieces) supporting the seat and back assembly. The frame pieces are configured to be detachably connected together (and/or detachably connected to the seat and back assembly), such as by key and keyhole fasteners and screws, in the sense that they can easily be disconnected from each other (or from the seat and back assembly) after being connected together, and then easily reconnected. Preferably, the seat and back assembly comprises a lower back and seat portion, an upper back portion, and hinges which allow the lower back and seat portion to pivot relative to the upper back portion. Also preferably, the hinges allow the seat and back assembly to be folded following disassembly from the frame.

Preferably, the chair has a flexible frame, an ergonomically beneficial design which allows at least the upper back to recline relative to the frame, and is easily disassembled. In its disassembled form, chair comprises flat (or substantially flat) components which can be efficiently stored or packaged (e.g., so as to occupy a space much smaller than that required to package the assembled chair). The design provides for easy assembly of the disassembled chair. The chair can be shipped in its disassembled form and assembled easily without any need for welding. Preferably, the frame is made of pieces of metal tubing and connectors.

In a class of embodiments, the invention is a knock-down chair which is ergonomically designed to provide a comfortable seat which is automatically urged upward and forward (by a flexing frame) when the user tilts the upper portion of the chair's back into a reclining position.

BRIEF DESCRIPTION OF THE DRAWINGS

FIG. 12 is an exploded side view of a preferred implementation of one of hinges 40 of the FIG. 1 embodiment.

FIG. 13 is an exploded front view of the FIG. 12 implementation of hinge 40.

FIG. 14 is a side elevational view of an alternative embodiment the inventive chair which has no armrests.

DETAILED DESCRIPTION OF THE INVENTION

A preferred embodiment of the inventive chair will be described initially with reference to FIGS. 1–7. In this embodiment, the chair has two major components: seat and back assembly 20, and frame 30.

Figure 1:
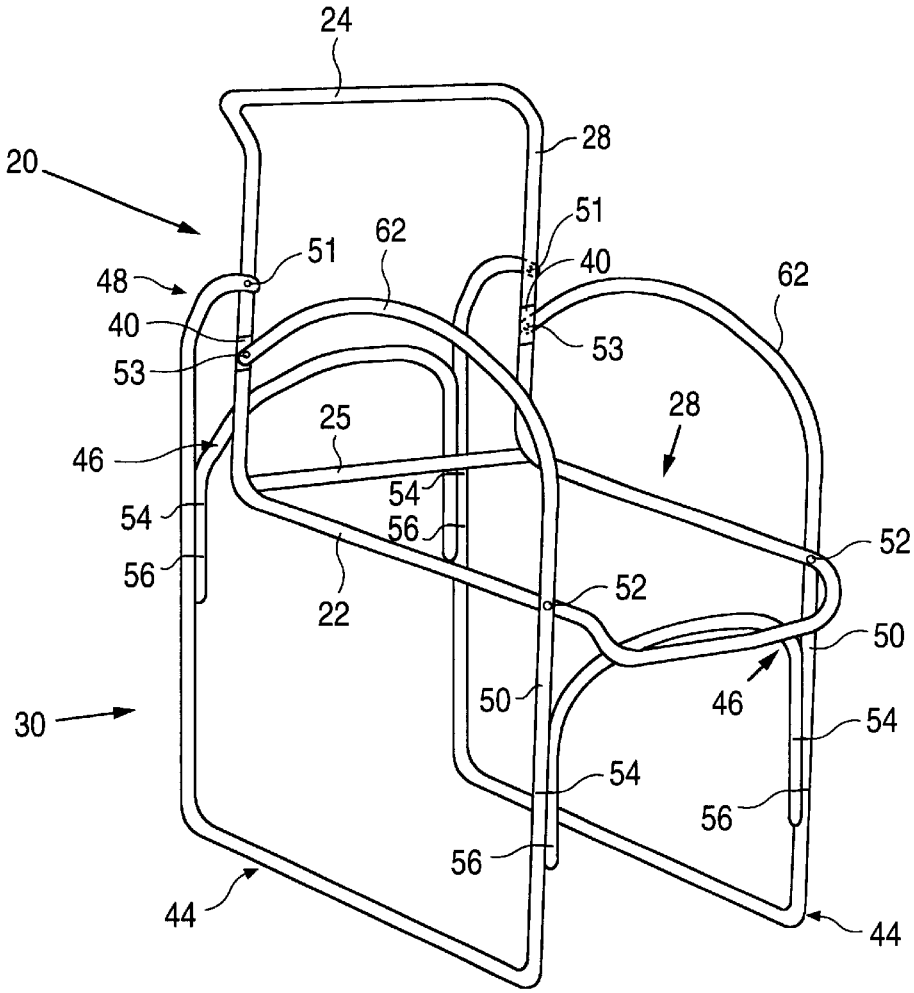
FIG. 1 is a perspective view of a preferred embodiment of the inventive chair without a covering (e.g., a fabric covering) over the tubular frame portion of the seat and back assembly.

Seat and back assembly 20 includes upper back portion 24, seat and lower back portion 22, hinges 40 (which connect portion 22 to portion 24), fabric (not shown in FIG. 1) or other seat material stretched over portions 22 and 24, and optionally also crossbar 25 connected between opposite sides of portion 22 as shown in FIG. 1. For convenience, the seat and lower back portion of the invention (e.g., seat and lower back portion 22 of FIG. 1) will be referred to herein (including in the claims) as a "seat portion" although it typically includes a generally vertical portion (as does portion 22 of FIG. 1) for supporting a generally vertical portion of the seat material (which in turn provides lumbar support for a seated user's lower back), in addition to a generally horizontal portion of the seat material (on which the user sits). Similarly for convenience, the upper back portion of the invention (e.g., upper back portion 24 of FIG. 1) will be referred to herein (including in the claims) as a "back portion" although it typically supports only that portion of the seat material which supports a seated user's upper back (and which does not support the user's lower back).

In alternative embodiments, the vertical part of seat portion 22 is omitted, and the flat (horizontally oriented) seat portion is connected to and supported by back legs 48 or the cross-piece 46 at the rear of the chair. In such embodiments, hinges 40 would connect the ends of armrests 62 with back portion 24 (e.g., with a fitting 91 of the FIG. 12 embodiment of hinge 40 fixed to each end of armrest 62 and a fitting 92 fixed to a corresponding end of portion 24), so that the hinges allow back portion 24 to pivot relative to seat portion 22 and side pieces 44.

Figure 6:
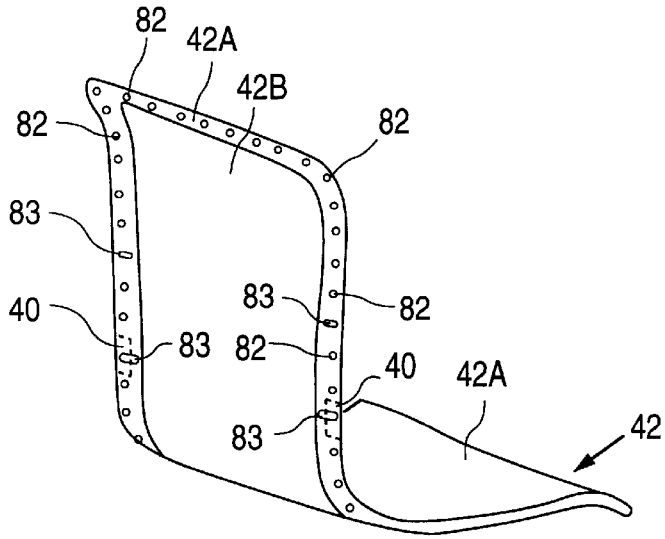
FIG. 6 is a perspective view of the fabric covering of the seat and back assembly of FIG. 1, showing fasteners for stretching the covering over the tubular frame portion of the seat and back assembly.
Figure 2:
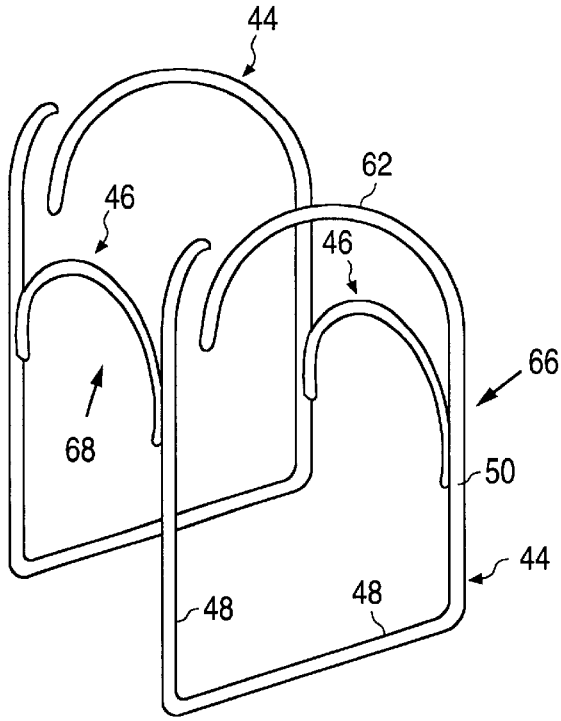
FIG. 2 is a perspective view of the supporting frame of the chair without the seat and back portion of the chair.
Figure 3:
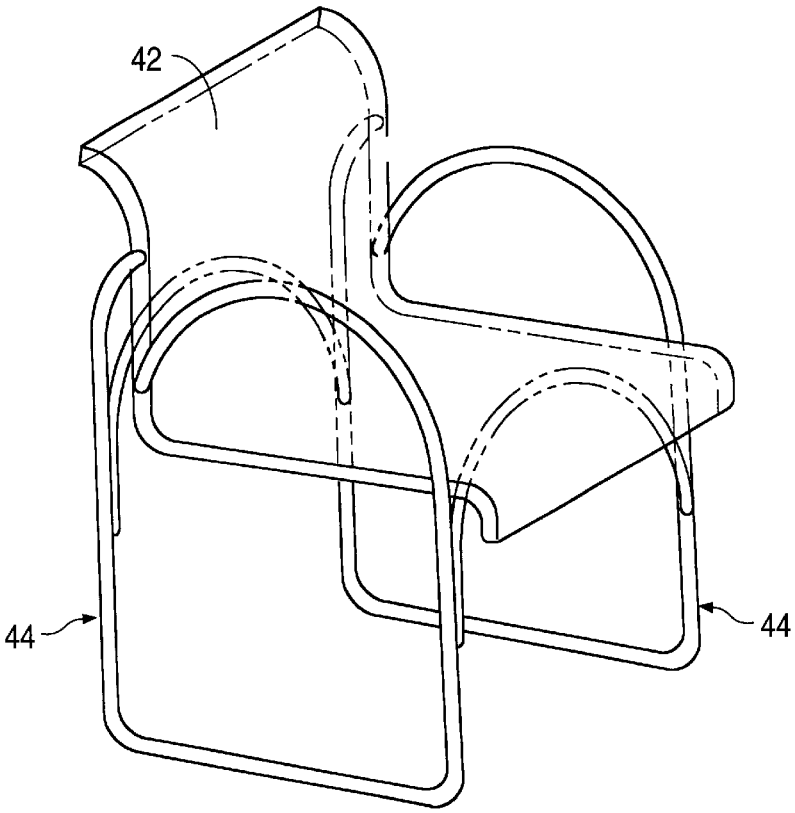
FIG. 3 is a perspective view of the chair of FIG. 1, with a covering (e.g., a fabric covering) over the tubular portion of the seat and back assembly.

Preferably, seat and back assembly 20 includes frame 28 (made of metal tubing or other suitable material) and fabric (or other suitable material) 42 stretched over frame 28 to provide a surface on which the user can sit and rest his or her back. In a preferred implementation, portion 24 of frame 28 is tubing having ⅝ inch diameter and portion 22 of frame 28 is tubing having ⅝ inch diameter. As shown in FIGS. 3 and 6 (but not FIG. 1), fabric 42 is stretched over frame 28 to provide a surface on which the user can sit and rest his or her back. In the preferred embodiment, the tubing of frame 28 includes two continuous pieces which are joined two each other by the hinges 40 on either side of the chair. Frame 28 can alternatively be formed from more than two separate pieces of tubing.

Frame 30 is preferably made of metal tubing (¾" diameter tubing in one embodiment), and connectors (to be described). In the preferred embodiment of FIGS. 1–7, frame 30 comprises two identical side pieces of metal tubing (pieces 44) and two identical cross-arch pieces of metal tubing (pieces 46). Each piece 44 of frame 30 preferably includes an armrest portion 62 for connection to back portion 24 (at points 26) by hinges 40 (to be discussed in more detail below). In alternative embodiments (e.g., that shown in FIG. 13), armrest portions 62 are omitted.

Each side piece 44 of frame 30 has a rear leg portion 48 which is detachably connected to back portion 24 by connectors 51, such that back portion 24 is free (or at least has limited freedom) to pivot relative to pieces 44. In preferred implementations, connectors 51 are screw and plug connectors, since this type of connector provides the benefit of being easy to assemble (and disassemble) and creates a pivot point between each side piece 44 and back portion 24 of the seat and back assembly. Connectors 52 detachably connect front leg portions 50 of side pieces 44 to frame 28 of seat and back assembly 20. Preferably, connectors 52 (and connectors 53 to be described below) are screw and plug connectors which allow pivoting motion between the elements they connect. Alternatively, connectors 52 are simply implemented by screws (or bolts or similar elements) passing through the outside of each piece 44 through a plastic grommet glued to the fabric (which covers frame 28) and into a hole in the sidewall of portion 22 of frame 28.

Each side piece 44 of frame 30 has a rear leg portion 48 extending downward from pivoting connector 51. From rear leg portion 48, each side piece 44 has a bottom portion 49 extending forward (along the floor) to front leg portion 50, and armrest portions 62 extend toward the back of the chair from front leg portions 50. Each armrest portion 62 has an arched shape and extends between connector 52 (at front leg portion 50) and connector 53 (which connects armrest portion 62 to hinge 40).

Leg portion 50 of each side piece 44 is connected to frame 28 of the seat and back assembly by one of connectors 52, one cross-arch piece 46 is detachably connected between leg portions 50 (preferably by screws or keyhole/key connections), and another cross-arch piece 46 is detachably connected between leg portions 48 (preferably by screws and/or keyhole/key connections).

The ends of each arch piece 46 are parallel to leg portions 50 (or 48) of side piece 44 to allow for two screw (and/or keyhole/key) connections along the overlapping portion of each arch piece with one of leg portions 48 and 50. Since there are two connections between each arch piece 46 and each leg portion of each side piece 44, frame 30 provides good lateral support to the chair.

Figure 10:
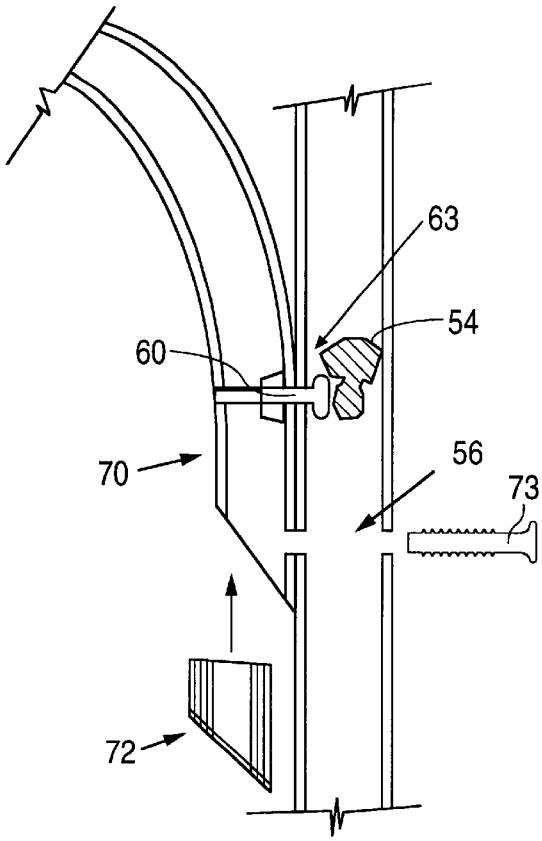
FIG. 10 is a cross-sectional view of a preferred connection between one of the cross pieces and one of the leg portions of the frame of the FIG. 1 embodiment.
Figure 11:
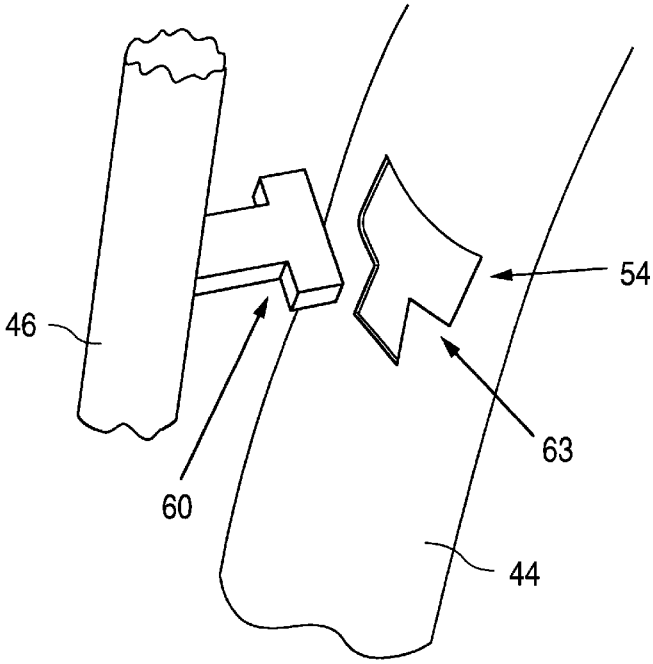
FIG. 11 is an enlarged perspective view of one implementation of the connection of FIG. 10.

Cross-arch pieces 46 are attached to side pieces 44 of the frame at the front side 66 of the chair and back side 68 of the chair. As shown in FIGS. 10 and 11, key and keyhole connections (each comprising a key 60 protruding from a side piece 46, and a keyhole slot 63 in the front or rear leg portion of the piece 44) and screw and plug connections (each comprising a screw 73 and a plug 72) are preferably used to connect pieces 46 to side pieces 44. One keyhole slot 63 is provided at each of locations 54 along each of leg portions 48 and 50 of each side piece 44 (so that there are preferably a total of at least four keyholes 63 in frame 30, and two keys 60 protruding from each piece 46). Preferably, each keyhole 63 is basically T-shaped as shown in FIG. 11. To assemble each piece 46 to the rest of the frame, one of keys 60 (of the piece 46) is inserted into the horizontally oriented upper portion of a corresponding keyhole 63 and the key is then pushed downward (to lock the key in the vertically oriented lower portion of the keyhole). Other shapes of key and corresponding keyhole are possible, but the shape of each key and the keyhole corresponding thereto should be such that when the key is moved into a locking portion of the keyhole, the key cannot be pulled directly out of the keyhole. With reference to FIG. 11 (assuming key 60 has been locked in the vertically oriented lower portion of keyhole 63), in order to pull key 60 out of keyhole 63, one would first need to slide key 60 upward to the upper part of the keyhole.

To secure each key 60 in a locked position in the lower portion of a corresponding keyhole 63 (at each location 54), at least one screw 73 is extended into aligned holes (at each location 56) through each leg of piece 44 and each arch piece 46.

After assembly of a key and keyhole connection, the adjacent screw and plug connection is assembled as follows. A plug 72 is inserted into an end of piece 46 and a corresponding portion of one of pieces 44 (at each of locations 56), so that a threaded hole extending through the side of plug 72 is aligned with the aligned holes of pieces 46 and 44. Then a screw 73 is screwed into the three aligned holes of elements 44, 46, and 72 to connect these three elements together. In a variation, screw 73 is inserted through aligned holes that extend through cross-arch piece 46 and the corresponding piece 44 (at each of locations 56) to connect together pieces 44 and 46. Then, a plug 72 is inserted into the open end of the cross-arch piece 46 to cover the open end and the screw 73 which secures piece 46 to piece 44. A bolt (or other connector) can be substituted for a screw in alternative embodiments.

In another embodiment, plugs 72 are omitted (and screws 73 or bolts alone are used at each location 56). In another embodiment, each key and keyhole connection comprises a key protruding one of side pieces 44 and a keyhole slot in cross piece 46 to be detachably coupled thereto. In another embodiment, the keyhole/key connections are omitted and replaced by screw (or screw and plug) connections so that two screws connect each leg of piece 44 to each end of each piece 46 (at the eight locations 54 and 56). In preferred implementations of the latter embodiment, there are two holes through each leg of piece 44 (at locations 54 and 56), and an elongated gasket (having two threaded holes extending therethrough) is fitted between each leg and the adjacent piece 46 with one threaded hole of the gasket aligned with each pair of aligned holes through pieces 46 and 44 (at locations 54 and 56). The gasket is shaped to conform to the facing surfaces of the relevant leg of piece 44 and of piece 46. Then, a screw 73 is screwed through each set of aligned holes of pieces 46 and 44 and the gasket.

An advantage of the design of frame 30 of FIG. 1 (with the described connections between side pieces 44 and seat and back assembly 20) is that it has no pinch point, in the sense that it presents essentially no risk that a user seated on the chair will be pinched as the user causes the chair to move between the upright and reclining positions.

Figure 4:
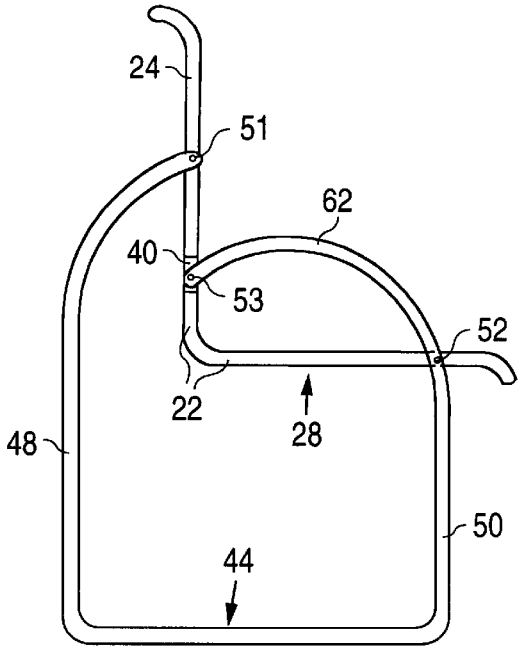
FIGS. 4 and 5 are side elevational views of the FIG. 1 chair showing how the chair's back flexes through its range of tilt.
Figure 5:
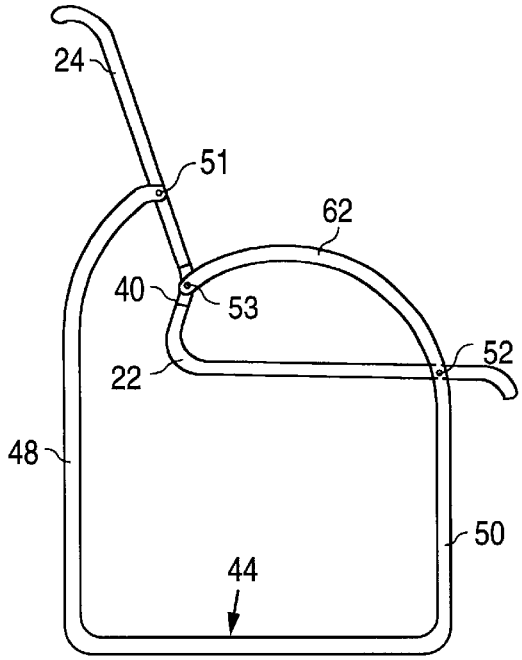

With reference to FIGS. 1, 4, and 5, we next describe the tilting action of back portion 24 (of frame 28 of seat and back assembly 20) relative to portion 22 (of frame 28). When the chair is in an upright position as shown in FIG. 4, rear legs 48 of side pieces 44 (of frame 30) exert a natural spring action on back portion 24 (toward the front of the chair) which biases portion 24 in the upright position of FIG. 4.

When a user presses his or her back against portion 24 (toward the back of the chair), the force exerted by the user overcomes the biasing force exerted by legs 48. This causes portion 24 to pivot about hinges 40 into a reclining position as shown in FIG. 5 (while pivoting connectors 51 allow portion 24 to rotate relative to side pieces 44), and bends rear legs 48 of side pieces 44 (away from the chair's front) relative to front legs 50. Preferably, hinges 40 are implemented so that they allow portion 24 limited freedom to pivot relative to frame 30 from the upright position to (but not beyond) a maximally reclining position (e.g., the position of portion 24 in FIG. 5). Preferably, hinges 40 provide a stop (back stop) which prevents pivoting of portion 24 relative to frame 30 (in one rotational direction) beyond the maximally reclining position, and a stop (forward stop) which prevents pivoting of portion 24 relative to frame 30 (in the other rotational direction) beyond the fully upright position.

Back portion 24 (of seat and back assembly 20) functions as a lever when the user moves the chair into a reclining position, and pivoting connectors 51 are the fulcrum for this lever. In typical implementations of the FIG. 1 (or FIG. 14) embodiment in which pivoting connectors 51 are positioned approximately midway between the bottom end of the lever (where hinges 40 are attached) and the top end of the lever (the uppermost region of portion 24 against which the user's back or shoulders exert force), the bottom end of the lever does not translate significantly relative to the stationary surface (to be referred to as the "floor") on which the chair rests (and thus hinges 40 do not translate significantly relative to the floor) when the user moves the chair into a reclining position. This is true whether the chair frame has armrest portions (e.g., portions 62 shown in FIG. 1) or does not have armrest portions (as in the FIG. 14 embodiment), since the front leg, rear leg, and runner (between the front and rear legs) on each side of the frame function as spring that flexes to allow one connector 51 (but not the corresponding hinge 40) to translate relative to the floor. Specifically, the rear leg flexes relative to the runner and front leg on each side of the frame, while the front leg and the corresponding hinge 40 (and the seat portion 22 of seat and back assembly 20) do not move significantly relative to the floor (except that one portion of hinge 40 pivots relative to the rest of hinge 40).

In some alternative implementations of the chair (in which the frame has armrest portions), the back portion of the chair's seat and back assembly functions as a lever whose bottom end does translate significantly relative to the floor when the user moves the chair into a reclining position. For example, in some such alternative implementations when the user pivots the back portion into the reclining position relative to the frame, the pivoting back portion and the armrest portions of the frame exert force on the hinges (which connect the back portion of the seat and back assembly to the seat portion of such assembly) which causes the hinges to react by translating upward and forward relative to the floor (thereby pulling the rear edge of the seat portion upward and forward). The resulting tilting motion of the seat portion provides ergonomic support for the reclining user. To allow the seat portion to tilt in this manner, the connectors between the frame and the front of the seat portion (which correspond to connectors 52 and 53) should be implemented to allow the seat portion freedom to pivot relative to the side pieces of the frame.

Figure 8:
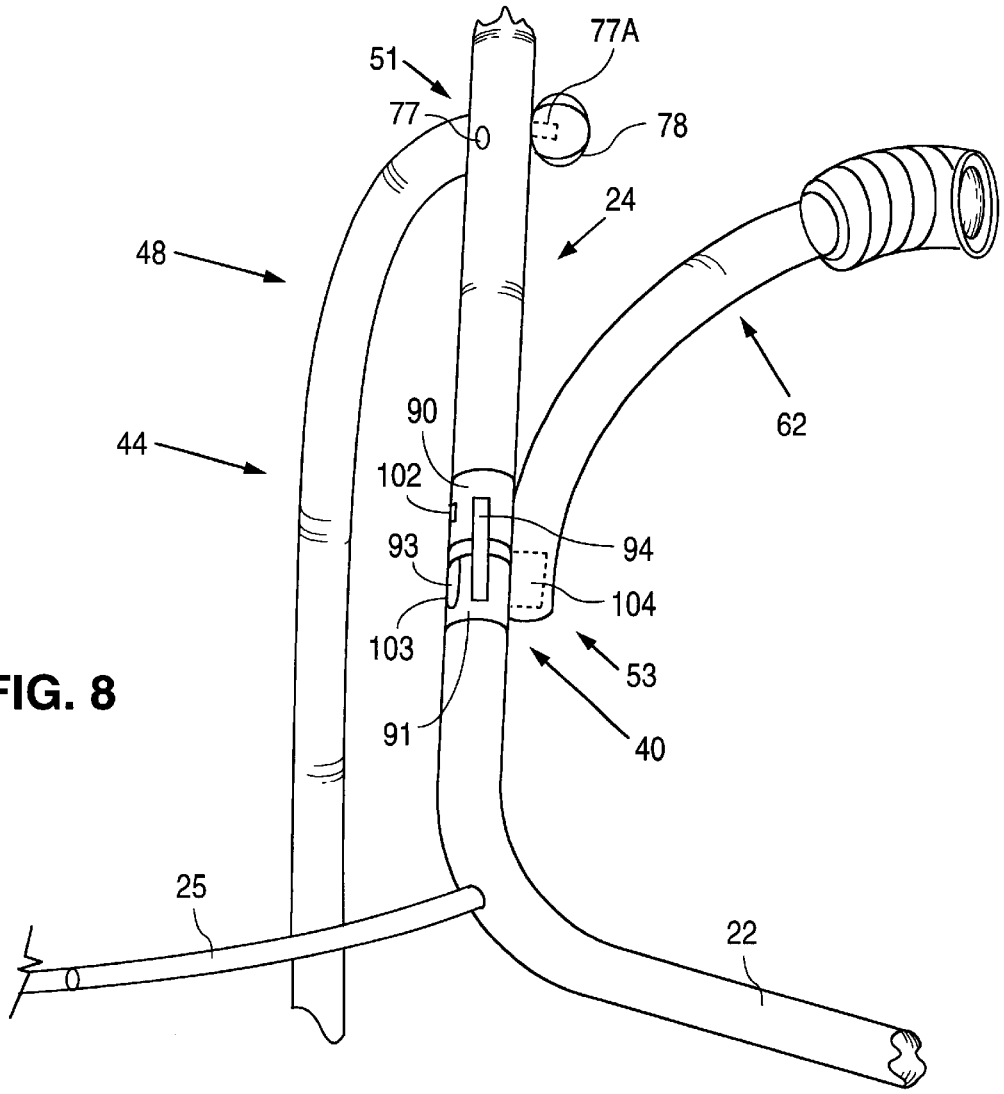
FIG. 8 is a perspective view of a preferred implementation of connectors 51 and 53 between the seat and back portion and frame, and of hinge 40 of the seat and back portion, at the back of the FIG. 1 embodiment of the invention.

Next, a preferred implementation of each hinge 40, connector 51, and connector 53 will be described with reference to FIGS. 8, 9, 12, and 13. In this implementation, hinge 40 allows portion 24 limited freedom to pivot relative to frame 30 by up to thirty degrees from the upright position to a maximally reclining position. In the implementation of FIGS. 8, 12, and 13, hinge 40 includes end fittings 90 and 91 (having threaded holes 92 and 93 therethrough), center plate 94, and screws 102 and 103. Plate 94 has two threaded holes 95 and 96 extending through it. In the preferred implementation, each of connectors 53 comprises plug 104 and screw 103. Assuming that each of portions 24 and 22 is composed of metal tubing, and has open tubular ends (with cylindrical side walls) for coupling to hinges 40, fitting 90 is generally cylindrical (with a slot 97 at one end for receiving plate 94), and fitting 91 is generally cylindrical (with a slot 98 at one end for receiving plate 94).

To assemble each hinge 40, fitting 90 is fitted onto an open tubular end of back portion 24 and plate 94 is fitted into slot 97 of fitting 90, so that hole 92 of fitting 90 is aligned with hole 95 of plate 94 and with a hole through the sidewall of the open end of portion 24 (as shown in FIG. 8). Screw 102 is inserted into the three aligned holes to connect fitting 90 and plate 94 to portion 24 (such that portion 24 and fitting 90 have freedom to pivot together as a unit by up to 15 degrees relative to plate 94). Also, fitting 91 is fitted onto an open tubular end of seat portion 22 and the free end of plate 94 is fitted into slot 98 of fitting 91, so that hole 93 of fitting 91 is aligned with hole 96 of plate 94 and with a hole through the sidewall of the open end of portion 22 (as shown in FIG. 8). Screw 103 is inserted into the three aligned holes to connect fitting 91 and plate 94 to portion 22 (such that portion 22 and fitting 91 have freedom to pivot together as a unit by up to fifteen degrees relative to plate 94).

FIG. 8 also shows screw and plug connectors 51 and 53. Each connector 51 (only one shown in FIG. 8) detachably connects the upper end of rear leg 48 (of one of pieces 44) to back portion 24 of the seat and back assembly, so that portion 24 has freedom to pivot relative to leg 48. Connector 51 comprises screw 77 and plug 78. Plug 78 is inserted into an upper end of leg 48. In a preferred implementation, the end of leg 48 has a slot which exposes a threaded hole through the side of plug 78, when plug 78 is inserted in the leg end. Then, portion 24 is aligned with leg 48 so that the threaded hole extending through plug 78 is aligned with aligned holes of elements 48 and 24 (or a slot in element 48 that is aligned with a hole through element 24). Then a screw 77 is screwed into the three aligned holes (or holes and slot) of pieces 48, 24, and 78 (with the distal end 77A of screw 77 extending into plug 78) to pivotably connect piece 24 to elements 48 and 78. In a variation, screw 77 (or a bolt or other connector) is inserted into aligned holes that extend through portion 24 and the end of leg 48 (to pivotably connect together elements 24 and 48), and plug 78 is then inserted into the open upper end of the tubular leg 48 to cover the open upper end and the distal end 77A of screw 77 (or the distal end of the alternative connector). Plug 78 and leg 48 are fixedly connected together, but portion 24 has freedom to rotate (about the axis of screw 77) relative to plug 78 and leg 48.

Each connector 53 (only one shown in FIG. 8) detachably connects the free end of armrest 62 (of one of pieces 44) to seat portion 22 of the seat and back assembly, preferably so that portion 22 has freedom to pivot relative to armrest 62. Such freedom for portion 22 to pivot relative to armrests 62 is important to implement preferred embodiments of the chair in which, when the user pivots upper back portion 24 relative to legs 48 into portion 24's reclining position, side pieces 44 and hinges 40 react by pulling the back end of portion 22 upward and forward (thus providing an ergometric support for the reclining user), which desirable motion of portion 22 would be impeded if portion 22 did not have freedom to pivot relative to the free ends of armrests 62. Connector 53 comprises screw 103 (which it shares with hinge 40) inserted into aligned holes that extend through portion 22, fitting 91 of hinge 40, and the free end of armrest 62, and plug 104. Plug 104 and armrest 62 are fixedly connected together, but portion 22 (together as a unit with fitting 91) preferably has freedom to rotate (about the axis of screw 103) relative to plug 104 and armrest 62. Preferably, plug 104 is inserted into the free end of armrest 62 (before screw 103 is inserted), so that a threaded hole extending through plug 104 is aligned with the aligned holes of elements 22, 91, and 62. Then the screw 103 is screwed into the four aligned holes of pieces 22, 91, 62, and 104 to pivotably connect piece 22 (with fitting 91) to element 62 (with element 104). Alternatively, screw 103 is inserted to connect portion 22, fitting 91, and the free end of armrest 62, and then plug 104 is inserted into the open free end of armrest 62 to cover the distal end of screw 103.

Figure 9:
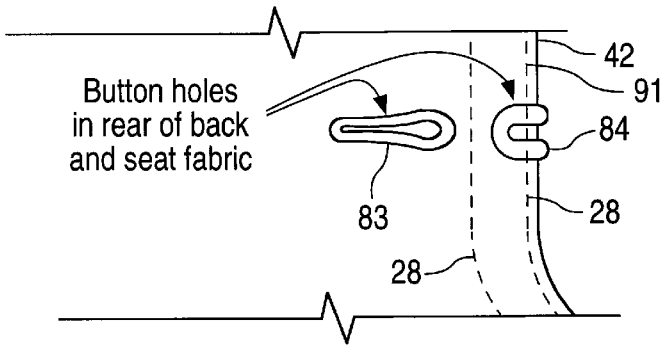
FIG. 9 is a perspective view of button holes which are present in a preferred implementation of the fabric covering of the seat and back assembly of the invention, at each location where the covering meets a plug connector of the type shown in FIG. 8.

When fabric (e.g., fabric 42 of FIG. 3) covers portions 22 and 24 of frame 28 of seat and back assembly 20, the fabric preferably has button holes 83 and 84 (as shown in FIGS. 6 and 9) at the location of each screw and plug connector. Alternatively, a zipper on each side of the fabric replaces holes 83. Such button holes (or zippers) provide access for the screws during assembly and disassembly of the screw and plug connectors. For example, at the location of screw and plug connector 51, button hole 83 is aligned with one end of hole 93 of fitting 91, and button hole 84 is aligned with the other end of hole 93. In FIG. 9, fitting 91 and frame 28 of seat and back assembly 20 are shown in phantom view since they are covered by fabric 42. To assemble hinge 40 (and connector 53), the distal end of screw 103 first passes through button hole 83, then into hole 93 (and through fitting 91), and then out of button hole 84 and into armrest 62. Similarly, to assemble connector 51, distal end 77A of screw 77 first passes through a button hole 83, then through portion 24 of frame 28, and then out of button hole 84 into leg 48.

With reference again to FIGS. 12 and 13, due to the fifteen degree angle between each of edges 94A and 94B of plate 94 and edge 94C of plate 94 (shown in FIG. 12), the assembled hinge 40 allows portion 24 freedom to pivot by up to thirty degrees relative to portion 22, but provides a back stop (edge 94A abutting the inner cylindrical surface of portion 24, and edge 94B abutting the inner cylindrical surface of portion 22) which prevents rotation of portion 24 (beyond the maximally reclining position) by more than thirty degrees (clockwise, in FIG. 12) relative to portion 22. Hinge 40 also provides a forward stop (edge 94C abutting the inner cylindrical surfaces of portions 22 and 24) which prevents portion 24 from rotating (counterclockwise, in FIG. 12) relative to portion 22 beyond the fully upright position.

In alternative embodiments, hinges 40 allow portion 24 limited freedom to rotate relative to portion 22 by more or less than thirty degrees (e.g., plate 94 is replaced by a plate having edges oriented at angles other than the angles at which edges 94A, 94B, and 94C are oriented).

In one implementation of hinge 40 of FIGS. 8, 12, and 13, each of fittings 90 and 91 has an overall length of 1.75 inch and an inner diameter adequate to fit over the tubing (having ⅜ or ⅝ inch diameter) comprising portions 22 and 24, plate 94 has ⅛ inch thickness, each of holes 92, 93, 95, and 96 has ¼ inch diameter, and the centers of holes 95 and 96 are separated by ½ inch.

Next, with reference to FIGS. 6 and 9, we describe a preferred implementation of fabric cover 42 for seat and back assembly 20. In this implementation, button holes 83 and 84 extend through fabric 42 at the location of each of plug and screw connectors 51 and 53 (as described above). Also, fasteners 82 (which can be metal snaps, hook and loop connector, or other fasteners) are provided around the outer edge of fabric 42, for use in attaching the fabric to frame 28 of the seat and back assembly 20. Each fastener 28 has an first component (closer to the outer edge of fabric 42) and a second component (farther from the outer edge of fabric 42). The outer edge of fabric is wrapped around frame 28 and each fastener 28 is manipulated to connect the fastener's first component (e.g., the male portion of a snap) to its second component (e.g., the female portion of the snap).

Of course, fabric 42 can be made of any of many materials including metal mesh as well as cloth (and can be replaced by suitable material other than fabric), and can be attached to frame 28 in any of many different ways. For example, in some embodiments the fabric is stretched over frame 28 and glued (or otherwise permanently adhered) to the frame. For another example, in another class of embodiments each portion (22 and 24) of frame 28 comprises a top half and a bottom half. To attach the fabric to frame 28, the top and bottom halves are separated, the fabric is inserted between them, and the top and bottom halves are reconnected (with the outer edge of the fabric sandwiched therebetween.

Figure 7:
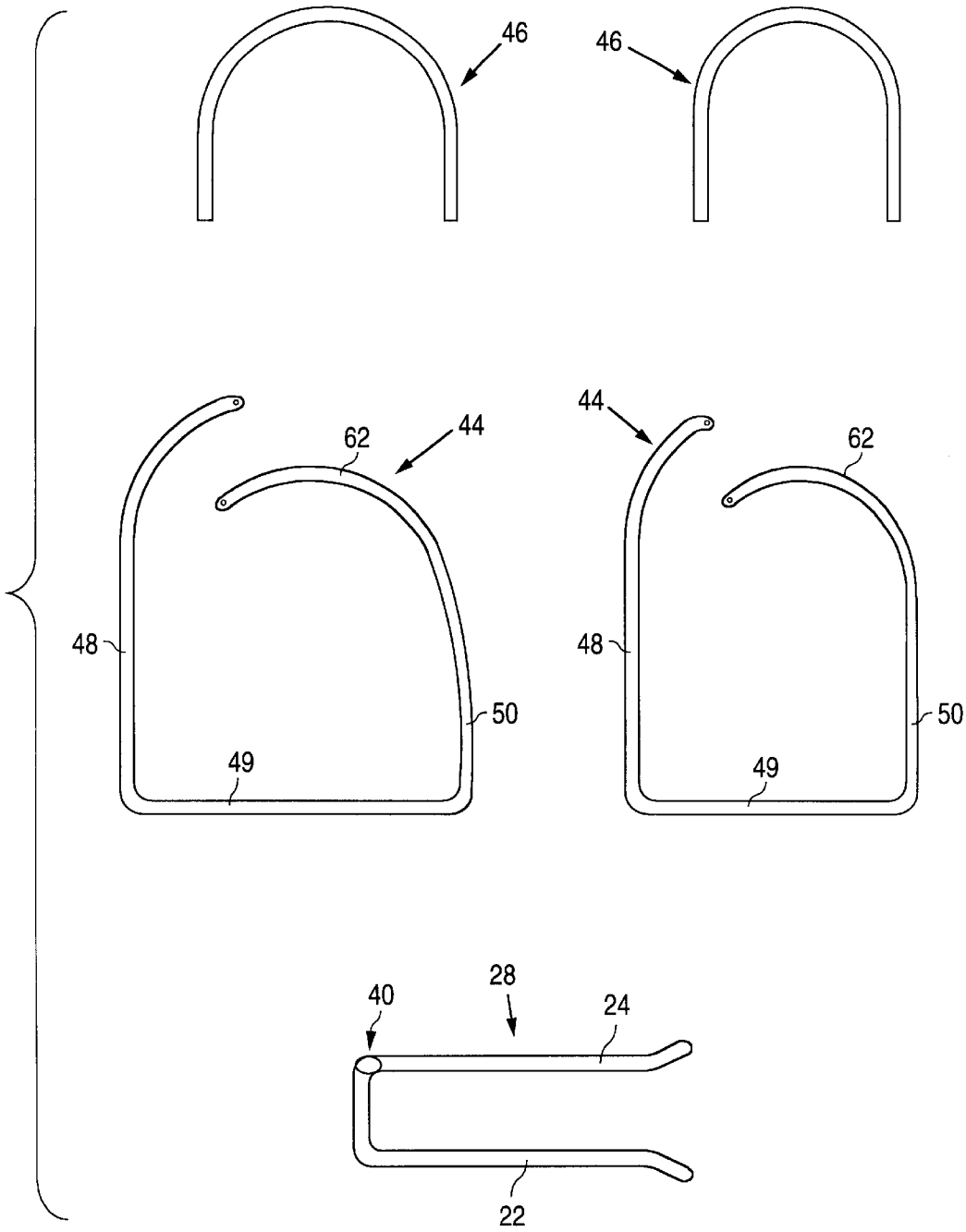
FIG. 7 is a side plan view of the chair of FIG. 1 in a disassembled state with the seat and back portion folded at its hinges to allow for packaging.

The main components of the chair of FIG. 1 can readily be disassembled into the configuration shown in FIG. 7. As shown in FIG. 7, the disassembled chair comprises two flat cross pieces 46, two flat side pieces 44, and frame 28 (including a flat seat portion 22 and a substantially flat back portion 24). Hinges 40 are disassembled (at least partially) so that they do not prevent portion 22 and 24 of frame 28 from being folded together (about hinges 40) into the substantially flat configuration shown. Alternatively, hinges 40 can be disassembled sufficiently so that portion 22 is completely disconnected and separated from portion 24. When the chair is disassembled, fabric 42 (not shown in FIG. 7) can either remain stretched over frame 28 or it can be removed and folded flat. In the disassembled state, the chair can be packaged in a box or other suitable container so that the packaged disassembled chair requires a much smaller amount of space for shipping or storage than would the assembled chair. From the disassembled state, the chair can be reassembled easily and quickly using simple tools and without welding.

An alternative embodiment of the inventive chair will next be described with reference to FIG. 14. The FIG. 14 embodiment is identical to that of FIG. 1, except in that side pieces 44' of the frame of FIG. 14 have a different shape than do side pieces 44 of frame 30 of FIG. 1. Specifically, side pieces 44' lack armrest portions 62. In FIG. 14, front leg portion 50' of each side piece 44' is detachably connected by connector 52' to frame 28 (of the seat and back assembly) but hinges 40 of the seat and back assembly are not connected to side pieces 44'.

While several different specific embodiments of the inventive chair have been discussed above, it will be apparent that numerous modifications thereof are within the scope of the following claims. For example, hinges 40 of the FIG. 1 embodiment can be replaced by other connectors which allow limited pivoting of portion 24 relative to frame 30 (but which provide a back stop preventing pivoting of portion 24 relative to frame 30 in one rotational direction beyond a maximally reclining position, and a forward stop which prevents pivoting of portion 24 relative to frame 30 in the other rotational direction beyond a fully upright position), or hinges 40 can replaced by a flexible portion of frame 28 (with forward and back stops which prevent pivoting of portion 24 relative to frame 30 in one rotational direction beyond a maximally reclining position and prevent pivoting of portion 24 relative to frame 30 in the other rotational direction beyond a fully upright position).

For another example bolts (or other similar connectors which perform substantially the same function as screws or bolts) can be substituted for screws in any of the described embodiments which include screws. For another example, in variations on the described embodiments, the frame pieces (which are preferably flat or substantially flat) are configured to be connected (but not detachably connected) to each other and to the seat and back assembly. In such variations, the assembled chair cannot readily be disassembled.

What is claimed is:

1. A chair, comprising:

a frame comprising pieces positioned in a configuration for supporting a seat and seat back,. wherein each of the pieces is at least substantially flat in shape; and a seat and back assembly detachably attached to the frame in a configuration for supporting a seated user, wherein the seat and back assembly includes a seat portion, a back portion, and a connection subassembly, wherein the connection subassembly is configured to connect the seat portion to the back portion with the back portion having freedom to pivot relative to the seat portion and the frame between a reclining position and an upright position, but with the back-portion being prevented from pivoting in a first rotational direction relative to the frame beyond the reclining position and the back portion being prevented from pivoting in a second rotational direction opposite to the first rotational direction relative to the frame beyond the upright position, and wherein the frame is configured to bias the back portion in the upright position but is sufficiently flexible to allow the user to move the back portion from the upright position into the reclining position.

2. The chair of claim 1, wherein the frame comprises:

a first side piece having a front leg portion and a rear leg portion;

a second side piece having a front leg portion and a rear leg portion;

a first pivoting connection assembly which detachably and pivotally connects the front leg portion of the first side piece and the front leg portion of the second side piece to the seat portion of the seat and back assembly; and a second pivoting connection assembly which detachably and pivotally connects the rear leg portion of the first side piece and the rear leg portion of the second side piece to the back portion of the seat and back assembly.

3. The chair of claim 2, wherein the first side piece has an armrest portion connected to the front leg portion, the second side piece also has an armrest portion connected to the front leg portion, and the frame also comprises:

a third pivoting connection assembly which detachably and pivotally connects the armrest portion of the first side piece and the armrest portion of the second side piece to the connection subassembly of the seat and back assembly.

4. The chair of claim 3, wherein the chair rests on a stationary surface, and the frame is configured so that when the user pivots the back portion from the upright position to the reclining position, the connection subassembly does not translate significantly, and the seat portion does not tilt significantly, relative to the stationary surface.

5. The chair of claim 3, wherein the frame is configured so that when the user pivots the back portion from the upright position to the reclining position, thereby causing the back portion to exert force on the first side piece, the second side piece, and the connection subassembly, at least one of the connection subassembly and the first side piece and the second side piece reacts by tilting the seat portion upward and forward, thereby causing the seat portion to provide ergometric support for the user as said user reclines.

6. The chair of claim 3, wherein the seat portion includes a first piece of tubing, the back portion includes a second piece of tubing, and the connection subassembly is a set of hinges, each of the hinges comprising:

a first fitting rigidly coupled to the first piece of tubing;

a second fitting rigidly coupled to the second piece of tubing; and a plate pivotably coupled between the first fitting and the second fitting, and wherein the third pivoting connection assembly is a set of screw and plug connectors, each of the screw and plug connectors including a connector that extends through the first piece of tubing and the armrest portion of one of the first side piece and the second side piece.

7. The chair of claim 2, wherein the seat portion of the seat and back portion includes a first piece of tubing, and the back portion of the seat and back portion includes a second piece of tubing, the first side piece is a third piece of tubing, and the second side piece is a fourth piece of tubing, and wherein the first pivoting connection assembly includes:

a first screw and plug connector including a connector that extends through the first piece of tubing and the third piece of tubing; and a second screw and plug connector including a second connector that extends through the first piece of tubing and the fourth piece of tubing.

8. The chair of claim 1, wherein the seat portion of the seat and back portion includes a first piece of tubing, and the back portion of the seat and back portion includes a second piece of tubing.

9. The chair of claim 8, wherein the connection subassembly is a set of hinges, each of the hinges comprising:

a first fitting rigidly coupled to the first piece of tubing;

a second fitting rigidly coupled to the second piece of tubing; and a plate pivotably coupled between the first fitting and the second fitting.

10. The chair of claim 1, wherein the pieces of the frame are detachably connected together in said configuration for supporting the seat and seat back.

11. The chair of claim 10, wherein the frame also comprises:

a first cross piece detachably connected between the front leg portion of the first side piece and the front leg portion of the second side piece; and a second cross piece detachably connected between the rear leg portion of the first side piece and the rear leg portion of the second side piece.

12. The chair of claim 11, wherein the first side piece is a third piece of tubing, the second side piece is a fourth piece of tubing, and also including:

a first key protruding from one of the first cross piece and the front leg portion of the first side piece, wherein the other of the first cross piece and the front leg portion of the first side piece defines a keyhole for receiving the first key; and a second key protruding from one of the first cross piece and the front leg portion of the second side piece, wherein the other of the first cross piece and the front leg portion of the second side piece defines a keyhole for receiving the second key.

13. The chair of claim 1, wherein the frame also comprises:

a first cross piece detachably connected between the front leg portion of the first side piece and the front leg portion of the second side piece; and a second cross piece detachably connected between the rear leg portion of the first side piece and the rear leg portion of the second side piece.

14. The chair of claim 13, wherein the first cross piece is detachably connected to the front leg portion of the first side piece by a first set of two connectors, wherein the connectors of the first set are separated from each other along the front leg portion of the first side piece, and the first cross piece is detachably connected to the front leg portion of the second side piece by a second set of two connectors, wherein the connectors of the second set are separated from each other along the front leg portion of the second side piece.

15. The chair of claim 1, wherein flexibility of the frame permits said frame to move in response to pivoting of the back portion into the reclining position, and wherein the back portion functions as a lever as it pivots into the reclining position.

16. The chair of claim 1, wherein the chair rests on a stationary surface, and the frame is configured so that when the user pivots the back portion from the upright position to the reclining position, the connection subassembly does not translate significantly, and the seat portion does not tilt significantly, relative to the stationary surface.

17. The chair of claim 1, wherein the connection subassembly is configured to be readily disassembled to allow the seat portion and the back portion to be folded together in a compact, at least substantially flat configuration.

18. A chair, comprising:

a frame comprising pieces positioned in a configuration for supporting a seat and seat back, wherein each of the pieces is at least substantially flat in shape; and a seat and back assembly detachably attached to the frame in a configuration for supporting a seated user, wherein the seat and back assembly includes a seat portion, a back portion, and a connection subassembly, wherein the connection subassembly is configured to connect the seat portion to at least one of the frame and the back portion, such that the back portion has freedom to pivot relative to the seat portion and the frame between a reclining position and an upright position, but such that the back portion is prevented from pivoting in a first rotational direction relative to the frame beyond the reclining position and the back portion is prevented from pivoting in a second rotational direction opposite to the first rotational direction relative to the frame beyond the upright position, and wherein the frame is configured to bias the back portion in the upright position but is sufficiently flexible to allow the user to move the back portion from the upright position into the reclining position.

19. The chair of claim 18, wherein the frame comprises:

a first side piece having a front leg portion and a rear leg portion;

a second side piece having a front leg portion and a rear leg portion;

a first pivoting connection assembly which detachably and pivotally connects the front leg portion of the first side piece and the front leg portion of the second side piece to the seat portion of the seat and back assembly; and a second pivoting connection assembly which detachably and pivotally connects the rear leg portion of the first side piece and the rear leg portion of the second side piece to the back portion of the seat and back assembly.

20. A chair, comprising:

a frame including a number of pieces detachably connected together in a configuration for 'supporting a seat and seat back, said frame including a first side piece and a second side piece, each of the first side piece and the second side piece comprising a flat piece of tubular material; and a seat and back assembly detachably attached to the frame in a configuration for supporting a seated user, wherein the seat and back assembly includes a second frame and fabric stretched over the second frame, wherein the second frame includes a seat portion, a back portion, a connection subassembly connecting the seat portion to the back portion, wherein the connection subassembly is configured to connect the seat portion to the back portion such that the back portion has freedom to pivot relative to the seat portion and the frame between a reclining position and an upright position, but the back portion is prevented from pivoting in a first rotational direction relative to the frame beyond the reclining position and the back portion is prevented from pivoting in a second rotational direction opposite to the first rotational direction relative to the frame beyond the upright position, and wherein the frame is configured to bias the back portion in the upright position but is sufficiently flexible to allow the user to move the back portion from the upright position into the reclining position.

21. The chair of claim 20, wherein the first side piece has a left front leg portion and a left rear leg portion and the second side piece has a right front leg portion and a right rear leg portion, and wherein the frame comprises:

a first pivoting connection assembly which detachably and pivotally connects the right front leg portion and the left front leg portion to the seat portion of the seat and back assembly; and a second pivoting connection assembly which detachably and pivotally connects the right rear leg portion and the left rear leg portion to the back portion of the seat and back assembly.

22. The chair of claim 21, wherein the first side piece has a left armrest portion connected to the left front leg portion, the second side piece also has a right armrest portion connected to the right front leg portion, and the frame also comprises:

a third pivoting connection assembly which detachably and pivotally connects the left armrest portion and the right armrest portion to the connection subassembly of the seat and back assembly.

23. The chair of claim 22, wherein the seat portion includes a first piece of tubing, the back portion includes a second piece of tubing, and the connection subassembly is a set of hinges, each of the hinges comprising:

a first fitting rigidly coupled to the first piece of tubing;

a second fitting rigidly coupled to the second piece of tubing; and a plate pivotably coupled between the first fitting and the second fitting, and wherein the third pivoting connection assembly is a set of screw and plug connectors, each of the screw and plug connectors including a connector that extends through the first piece of tubing and one of the left armrest portion and the right armrest portion.

24. The chair of claim 21, wherein the frame also comprises:

a first cross piece detachably connected between the left front leg portion and the right front leg portion; and a second cross piece detachably connected between the right rear leg portion and the left rear leg portion, each of the first cross piece and the second cross piece comprising a flat piece of tubular material.

25. The chair of claim 20, wherein the connection subassembly includes a left hinge connected between the seat portion and the back portion at a left side of the second frame and a right hinge connected between the seat portion and the back portion at a right side of the second frame, and wherein the seat and back assembly also comprises:

a support bar connected between the left side of the second frame and the right side of the second frame in a position such that the support bar supports the fabric to cause said fabric to provide improved lumbar support to the user.

26. A chair, comprising:

a frame comprising pieces positioned in a configuration for supporting a seat and seat back, wherein each of the pieces is at least substantially flat in shape; and a seat and back assembly attached to the frame in a configuration for supporting a seated user, wherein the seat and back assembly includes a seat portion, a back portion, and a connection subassembly, wherein the connection subassembly is configured to connect the seat portion to at least one of the frame and the back portion, such that the back portion has freedom to pivot relative to the seat portion and the frame between a reclining position and an upright position, but such that the back portion is prevented from pivoting in a first rotational direction relative to the frame beyond the reclining position and the back portion is prevented from pivoting in a second rotational direction opposite to the first rotational direction relative to the frame beyond the upright position, and wherein the frame is configured to bias the back portion in the upright position but is sufficiently flexible to allow the user to move the back portion from the upright position into the reclining position.

27. The chair of claim 26, wherein the frame comprises:

a first side piece having a front leg portion and a rear leg portion;

a second side piece having a front leg portion and a rear leg portion;

a first connection assembly which connects the front leg portion of the first side piece and the front leg portion of the second side piece to the seat portion of the seat and back assembly; and a pivoting connection assembly which pivotally connects the rear leg portion of the first side piece and the rear leg portion of the second side piece to the back portion of the seat and back assembly.

* * * * *